US011788449B2

(12) United States Patent
Hong et al.

(10) Patent No.: US 11,788,449 B2
(45) Date of Patent: Oct. 17, 2023

(54) EXHAUST GAS TREATMENT APPARATUS

(71) Applicant: KOREA SHIPBUILDING & OFFSHORE ENGINEERING CO., LTD., Seoul (KR)

(72) Inventors: Il-Gu Hong, Ulsan (KR); Do-Yun Kim, Ulsan (KR)

(73) Assignee: KOREA SHIPBUILDING & OFFSHORE ENGINEERING CO., LTD., Seoul (KR)

( * ) Notice: Subject to any disclaimer, the term of this patent is extended or adjusted under 35 U.S.C. 154(b) by 0 days.

(21) Appl. No.: 17/765,632

(22) PCT Filed: Sep. 28, 2020

(86) PCT No.: PCT/KR2020/013230
§ 371 (c)(1),
(2) Date: Mar. 31, 2022

(87) PCT Pub. No.: WO2021/066461
PCT Pub. Date: Apr. 8, 2021

(65) Prior Publication Data

US 2022/0372902 A1 Nov. 24, 2022

(30) Foreign Application Priority Data

Oct. 1, 2019 (KR) ..... 10-2019-0121672
Mar. 26, 2020 (KR) ..... 10-2020-0036753
Mar. 26, 2020 (KR) ..... 10-2020-0036757

(51) Int. Cl.
*F01N 3/04* (2006.01)

(52) U.S. Cl.
CPC ..... *F01N 3/04* (2013.01)

(58) Field of Classification Search
CPC ..... F01N 2610/1406; F01N 2610/1453; F01N 3/04; F01N 2590/02; F01N 2610/01; F01N 13/004; F01N 3/0807
See application file for complete search history.

(56) References Cited

U.S. PATENT DOCUMENTS

2009/0025554 A1 1/2009 Tahara et al.
2010/0229720 A1* 9/2010 Sonwane ..... B01D 53/1475 96/6
2015/0147252 A1* 5/2015 Sawamura ..... B01D 71/028 423/228

FOREIGN PATENT DOCUMENTS

JP 6-99018 4/1994
JP 2007-222847 9/2007
(Continued)

OTHER PUBLICATIONS

International Search Report for PCT/KR2020/013230 dated Jun. 10, 2021 (now published as WO 2021/066461) with English translation provided by WIPO.
(Continued)

*Primary Examiner* — Anthony Ayala Delgado
(74) *Attorney, Agent, or Firm* — Ladas & Parry, LLP

(57) ABSTRACT

An exhaust gas treatment apparatus is disclosed. An exhaust gas treatment apparatus according to an embodiment of the present disclosure includes a gas/liquid reactor contacting a treatment liquid and an emission-regulated gas included in exhaust gas, to absorb and remove the emission-regulated gas; a treatment liquid supply tank supplying the treatment liquid to the gas/liquid reactor; and a gas/liquid separation treatment liquid regeneration unit regenerating a waste treatment liquid in which the emission-regulated gas is absorbed, into a treatment liquid in which the emission-regulated gas is not absorbed, and supplying the regenerated treatment liquid to the treatment liquid supply tank, wherein the
(Continued)

gas/liquid separation treatment liquid regeneration unit includes a gas/liquid separation membrane through which a gas can pass but a liquid cannot pass.

19 Claims, 7 Drawing Sheets

(56) References Cited

FOREIGN PATENT DOCUMENTS

| | | |
|---|---|---|
| JP | 2009-226367 | 10/2009 |
| JP | 2010-005509 | 1/2010 |
| JP | 2012-236181 | 12/2012 |
| JP | 2014-156848 | 8/2014 |
| JP | 2017-200682 | 11/2017 |
| JP | 2019-205966 | 12/2019 |
| KR | 10-2012-0129309 | 11/2012 |
| KR | 10-1196932 | 11/2012 |
| KR | 10-1512459 | 4/2015 |
| KR | 10-2015-0114108 | 10/2015 |
| KR | 10-2016-0010956 | 1/2016 |
| KR | 10-2016-0119429 | 10/2016 |
| KR | 10-2019-0051249 | 5/2019 |
| WO | 2015/086898 | 6/2015 |

OTHER PUBLICATIONS

Written Opinion of the International Searching Authority for PCT/KR2020/013230 dated Jun. 10, 2021 (now published as WO 2021/066461) with English translation provided by Google Translate.

Johanna Beiron, et al., "Enhancement of CO2 Absorption in Water through pH Control and Carbonic Anhydrase—A Technical Assessment", Industrial & Engineering Chemistry Research, Jul. 9, 2019, vol. 58, pp. 14275-14283.

Extended European Search Report dated Jan. 23, 2023 for European Patent Application No. 20872782.6.

Yuexia Lv et al.: "Experimental studies on simultaneous removal of $CO_2$ and $SO_2$ in a polypropylene hollow fiber membrane contactor", Applied Energy, Elsevier Science Publishers, vol. 97, Feb. 10, 2012, pp. 283-288.

Mohammad Songolzadeh et al.: "Carbon Dioxide Separation from Fine Gases: A Technological Review Emphasizing Reduction in Greenhouse Gas Emissions", The Scientific World Journal, vol. 2014, Feb. 17, 2014, pp. 1-34.

International Preliminary Report on Patentability (Chapter I) for PCT/KR2020/013230 dated Apr. 5, 2022 and its English translation provided by WIPO (now published as WO 2021/066461).

Office Action dated May 15, 2023 for Korean Patent Application No. 10-2022-0007470 and its English translation by Google Translate.

Office Action dated Jul. 21, 2023 for Korean Patent Application No. 10-2022-0007470 and its English translation from Global Dossier.

Office Action dated Jun. 27, 2023 for Japanese Patent Application No. 2022-520160 and its English translation from Global Dossier.

* cited by examiner

【Figure 1】
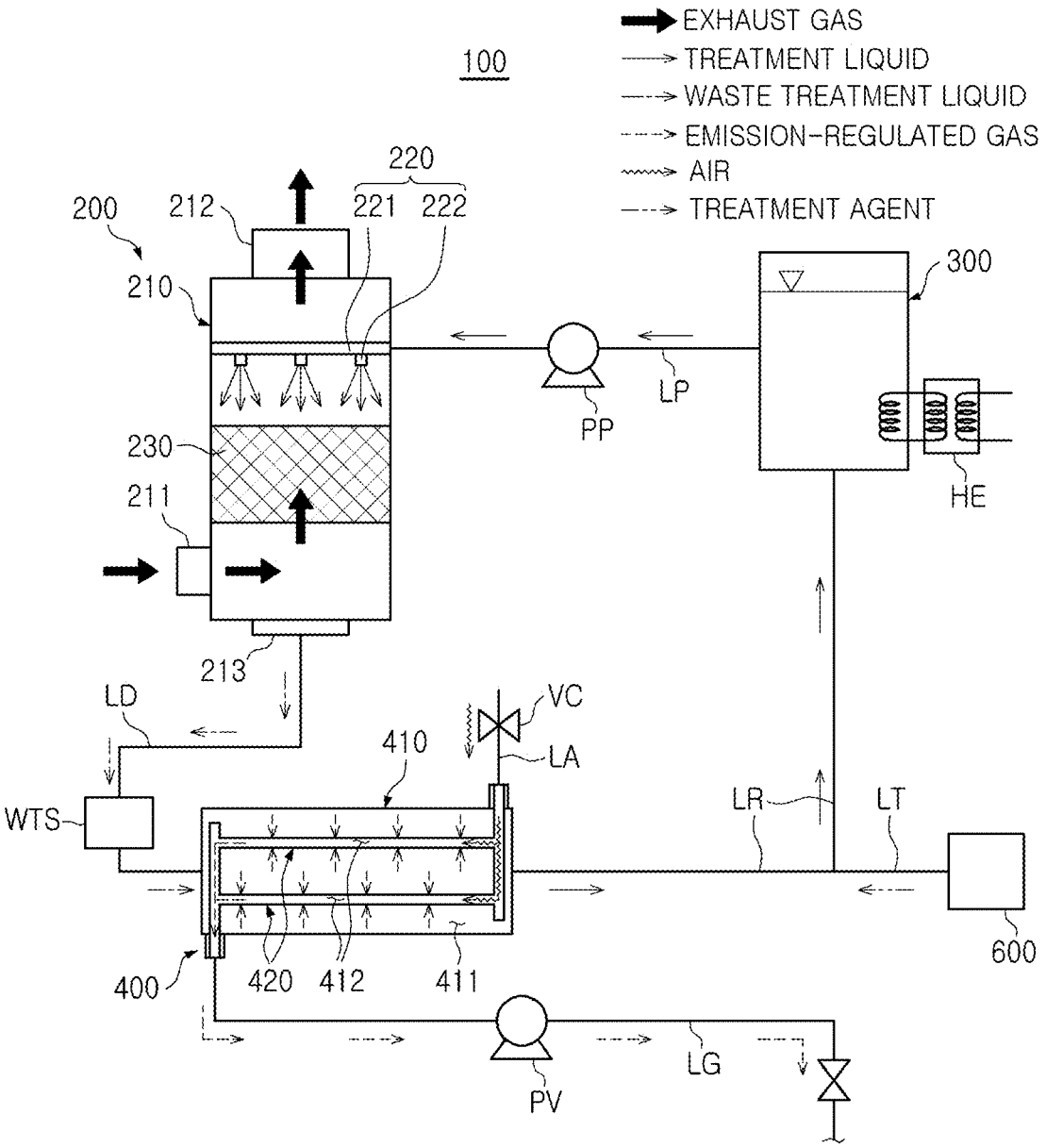

【Figure 2】
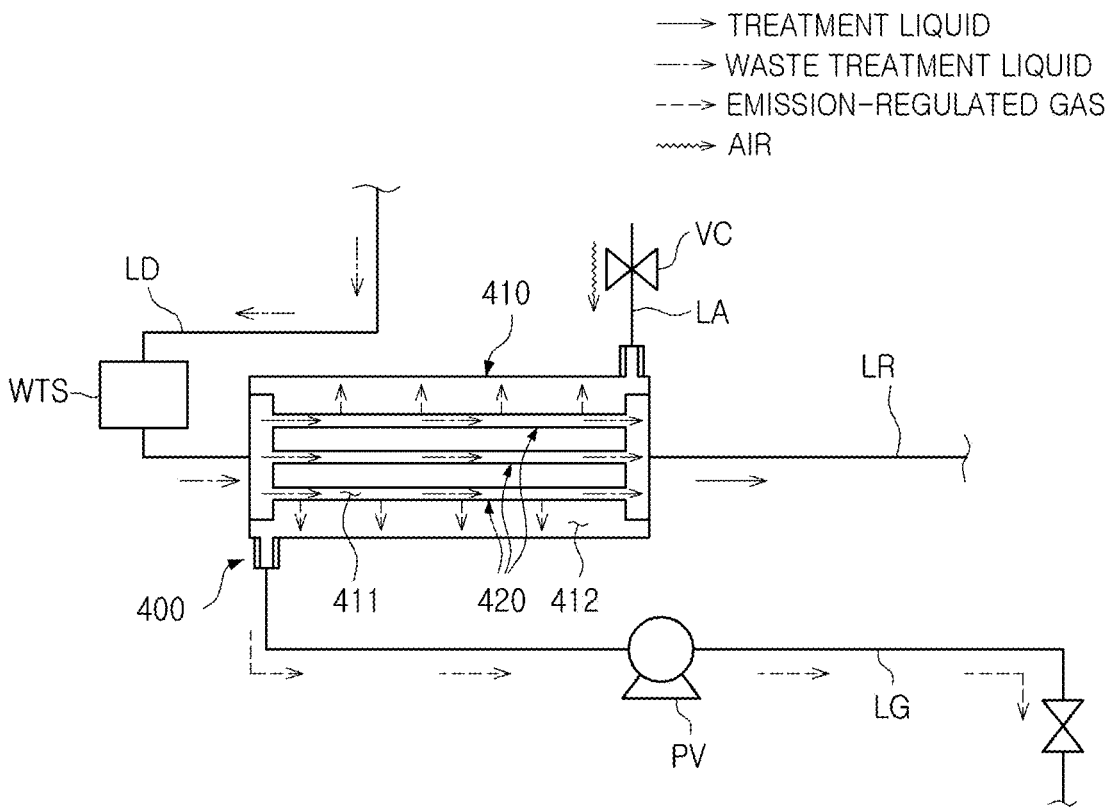

【Figure 3】
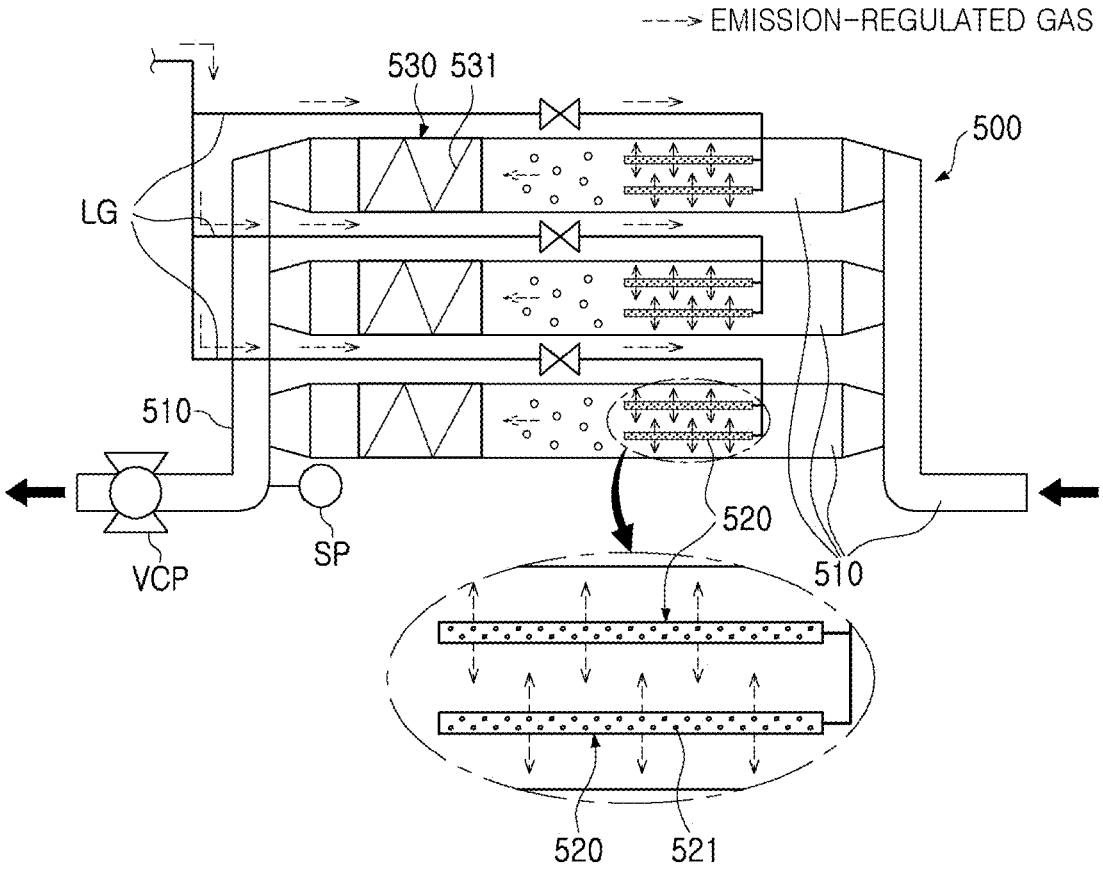

【Figure 4】
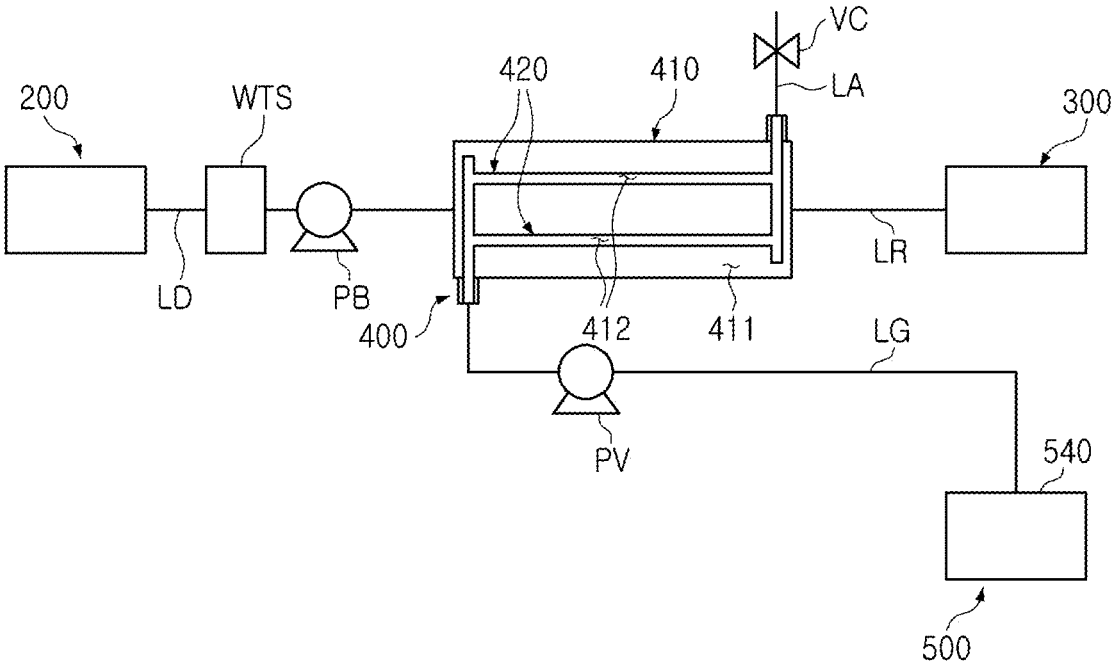

【Figure 5】
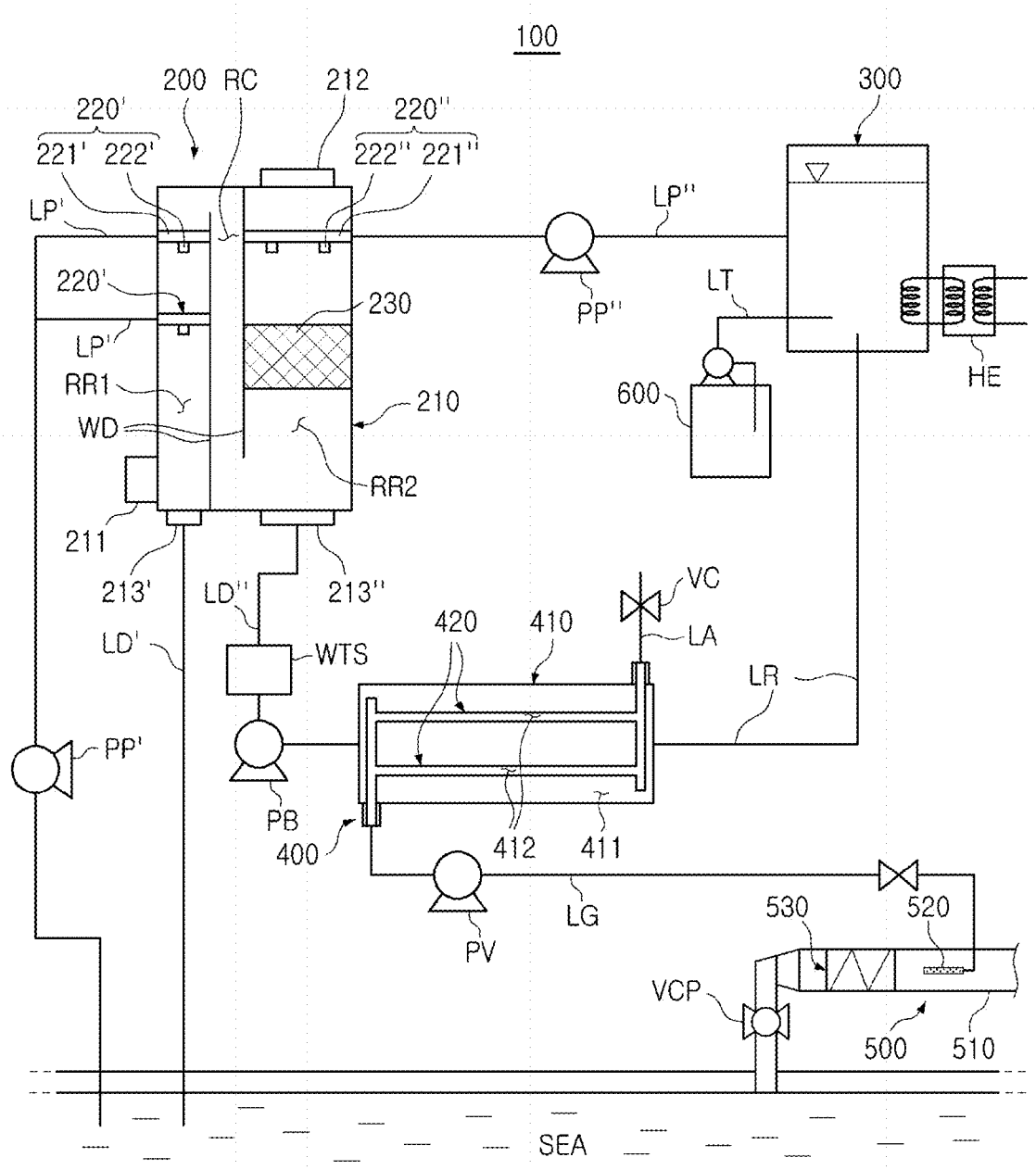

【Figure 6】
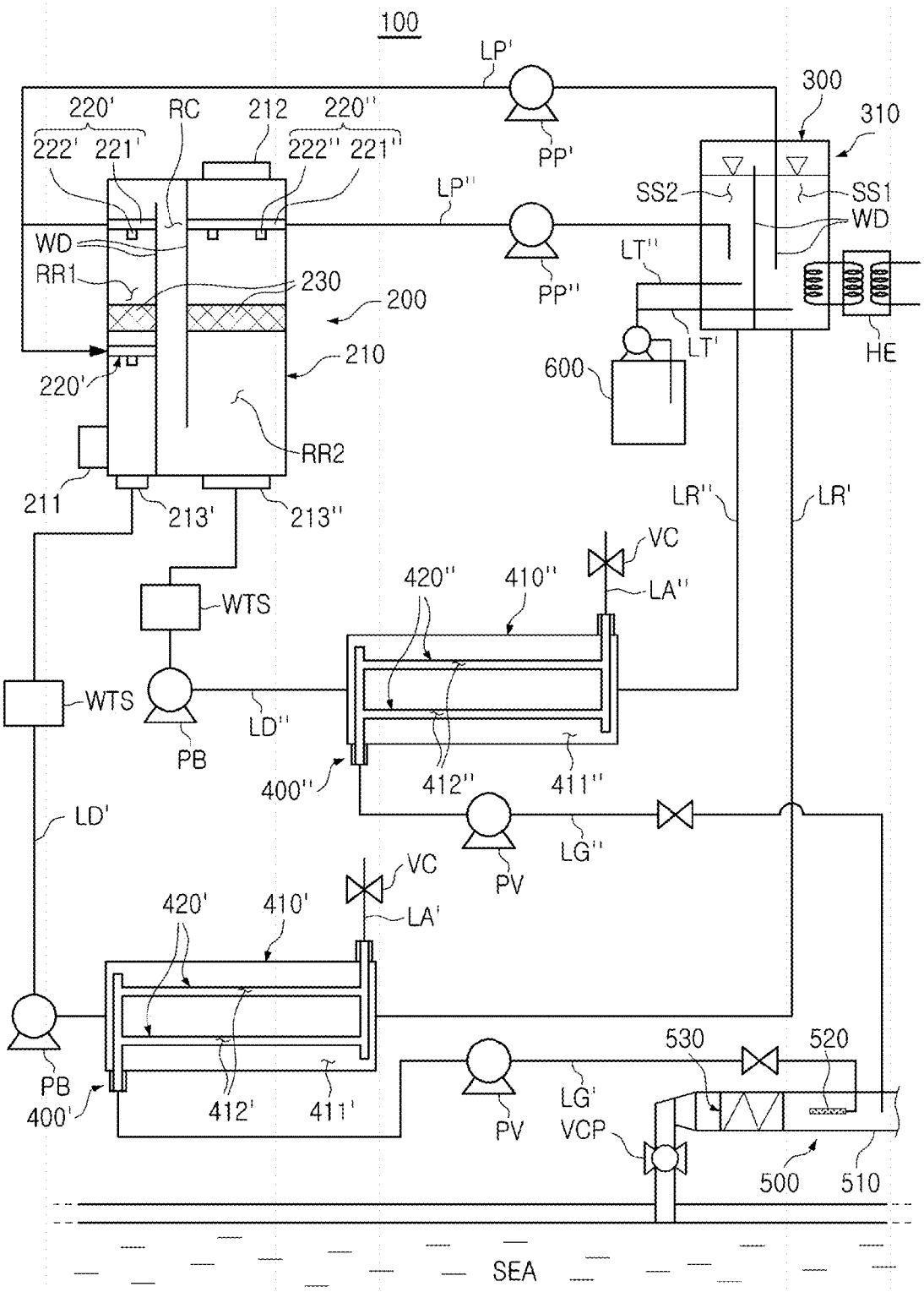

【Figure 7】
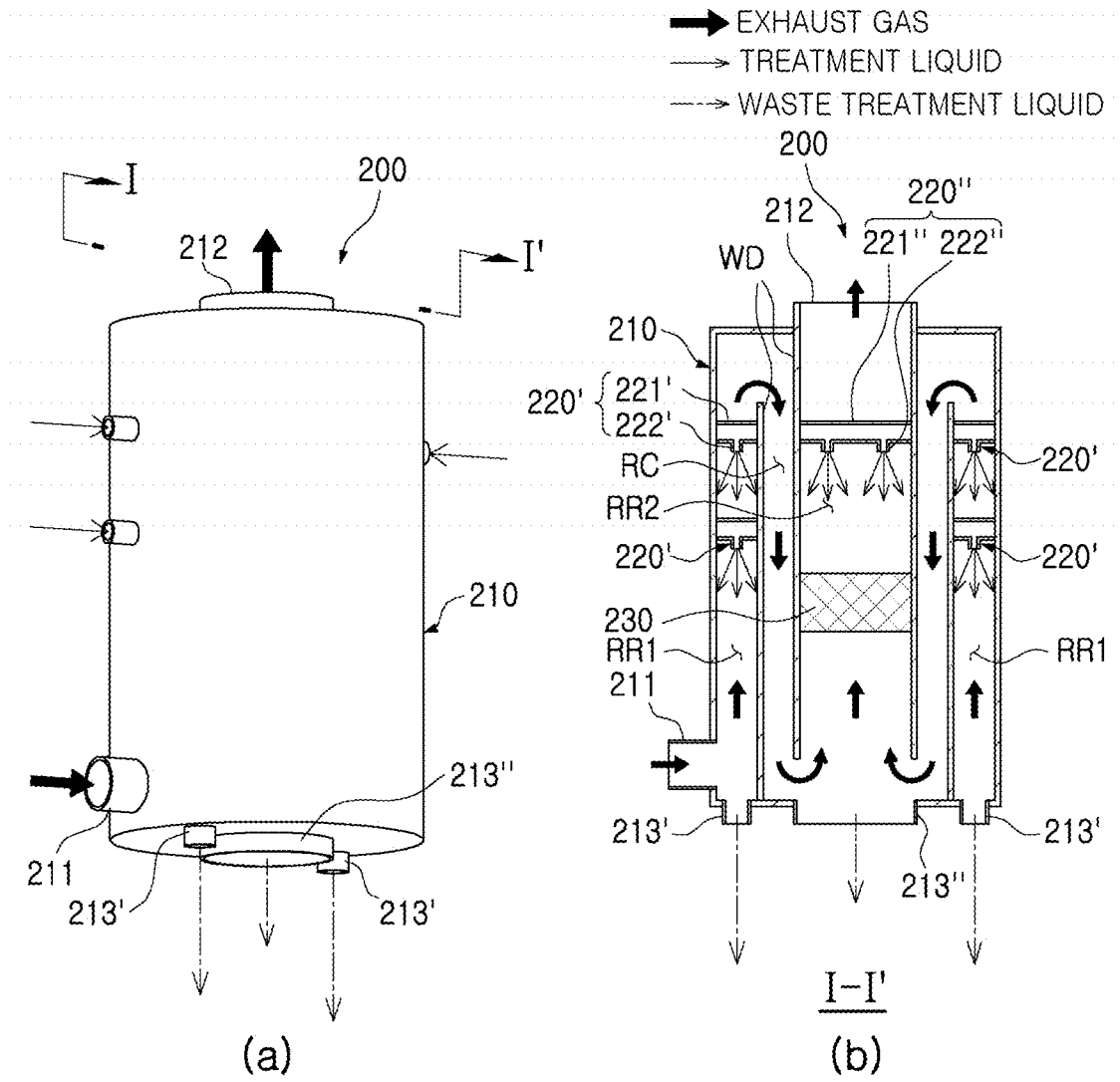

EXHAUST GAS TREATMENT APPARATUS

CROSS-REFERENCE TO RELATED APPLICATIONS

The present application is the national stage of International Patent Application No. PCT/KR2020/013230 filed on Sep. 28, 2020, which claims the priority to Korean Patent Application No. 10-2019-0121672 filed on Oct. 1, 2019, and Korean Patent Application No. 10-2020-0036753 filed on Mar. 26, 2020, and Korean Patent Application No. 10-2020-0036757 filed on Mar. 26, 2020, the entire contents of which are incorporated herein by reference.

TECHNICAL FIELD

The present disclosure relates to an exhaust gas treatment apparatus for treating exhaust gas.

BACKGROUND ART

As regulations on exhaust gas discharged from ships are increasingly being strengthened, there is a need to remove not only sulfur oxide but also carbon dioxide from the exhaust gas discharged from ships.

In order to treat exhaust gas, an exhaust gas treatment apparatus may be installed in ships, and the exhaust gas treatment apparatus may treat exhaust gas by spraying a treatment liquid into the exhaust gas. In the exhaust gas treatment apparatus, seawater may be used as the treatment liquid. If such seawater is used as the treatment liquid, sulfur oxide may be removed from the exhaust gas. However, since only a small amount of carbon dioxide may be removed, it has been difficult to realize performance in reduction of carbon dioxide that may satisfy the Energy Efficiency Design Index of the International Maritime Organization under the UN. In addition, since a relatively large amount of seawater may be required to treat exhaust gas, a facility for supplying and spraying a large amount of seawater may be required.

In addition, an alkaline aqueous solution such as an aqueous sodium hydroxide solution or the like may be used as the treatment liquid in the exhaust gas treatment apparatus. Although it was possible to treat the exhaust gas with a small amount of the alkaline aqueous solution, costs may be high. In order to reduce costs, in the exhaust gas treatment apparatus, a waste treatment liquid which has treated the exhaust gas may be regenerated and reused. However, in a conventional exhaust gas treatment apparatus, a regeneration rate of the waste treatment liquid may be low. Accordingly, since a treatment agent should be continuously supplied to a regenerated treatment liquid, costs have not been greatly reduced. In addition, equipment used to regenerate a waste treatment liquid may be large equipment, applicable to some land, and is difficult to apply to ships having an exhaust gas treatment apparatus.

DISCLOSURE

Technical Problem

The present disclosure is made based on recognition of at least one of the demands or problems occurring in the prior art as described above.

An aspect of the present disclosure is to reduce costs for treating exhaust gas in an exhaust gas treatment apparatus.

Another aspect of the present disclosure is to increase a regeneration rate of a waste treatment liquid which has treated exhaust gas.

Another aspect of the present disclosure is to reduce a size of an exhaust gas treatment apparatus.

Another aspect of the present disclosure is to separate an emission-regulated gas from a waste treatment liquid in which the emission-regulated gas included in the exhaust gas is absorbed, and treat the emission-regulated gas by dissolving the emission-regulated gas in seawater in an eco-friendly ion state.

Technical Solution

An exhaust gas treatment apparatus according to an embodiment for realizing at least one of the above problems may include the following features.

According to an aspect of the present disclosure, an exhaust gas treatment apparatus includes a gas/liquid reactor contacting a treatment liquid and an emission-regulated gas included in exhaust gas, to absorb and remove the emission-regulated gas; a treatment liquid supply tank supplying the treatment liquid to the gas/liquid reactor; and a gas/liquid separation treatment liquid regeneration unit regenerating a waste treatment liquid in which the emission-regulated gas is absorbed, into a treatment liquid in which the emission-regulated gas is not absorbed, and supplying the regenerated treatment liquid to the treatment liquid supply tank, wherein the gas/liquid separation treatment liquid regeneration unit includes a gas/liquid separation membrane through which a gas can pass but a liquid cannot pass, wherein the gas/liquid separation membrane partitions a liquid flow path through which the waste treatment liquid flows and a gas flow path through which the emission-regulated gas flows, and the emission-regulated gas absorbed in the waste treatment liquid flows through the liquid flow path and passes through the gas/liquid separation membrane, and moves to the gas flow path in which a low partial pressure of the emission-regulated gas is formed, to separate the emission-regulated gas and the treatment liquid.

In this case, a waste treatment liquid drain pipe connected to the gas/liquid reactor may be connected to one side of the liquid flow path, and the other side of the liquid flow path may be connected to the treatment liquid supply tank by a treatment liquid recovery pipe.

In addition, the waste treatment liquid drain pipe may include a filtration treatment unit filtering a pollutant, except for the emission-regulated gas included in the waste treatment liquid.

Further, a gas recovery pipe provided with a vacuum pump may be connected to one side of the gas flow path, to form the low partial pressure of the emission-regulated gas in the gas flow path.

In addition, an air inlet pipe provided with a flow control valve may be connected to the other side of the gas flow path, to control a partial pressure of the emission-regulated gas formed in the gas flow path.

Further, the gas/liquid separation membrane may be a hollow fiber membrane in which the gas flow path or the liquid flow path is formed.

In addition, the gas/liquid reactor may include a housing connected to an exhaust gas discharge device, and a treatment liquid spraying unit spraying the treatment liquid into the exhaust gas flowing through the housing.

Further, the treatment liquid spraying unit may include a treatment liquid flow pipe connected to the treatment liquid supply tank, passing through one surface of the housing, and provided in the housing, and a treatment liquid spraying nozzle provided in a portion of the treatment liquid flow pipe provided in the housing.

In addition, a heat exchanger may be connected to the treatment liquid supply tank, to cool the treatment liquid stored in the treatment liquid supply tank.

Further, the emission-regulated gas may be sulfur oxide or carbon dioxide, and the treatment liquid may be seawater or an alkaline aqueous solution.

According to another aspect of the present disclosure, an exhaust gas treatment apparatus includes a gas/liquid reactor contacting exhaust gas and a treatment liquid, to absorb and remove an emission-regulated gas included in the exhaust gas, in the treatment liquid; a gas/liquid separation treatment liquid regeneration unit separating the emission-regulated gas from a waste treatment liquid in which the emission-regulated gas is absorbed, drained from the gas/liquid reactor, to regenerate the waste treatment liquid as a treatment liquid; and a gas treatment unit treating the emission-regulated gas separated from the gas/liquid separation treatment liquid regeneration unit, wherein the gas treatment unit dissolves and treats the emission-regulated gas in seawater in an eco-friendly ion state.

In this case, the gas treatment unit may include a seawater flow pipe through which the seawater flows and to which a gas recovery pipe connected to the gas/liquid separation treatment liquid regeneration unit is connected.

In addition, a portion of the seawater flow pipe to which the gas recovery pipe is connected may be branched as a plurality of branched portions, and the gas recovery pipe may be branched and connected to the plurality of branched portions of the seawater flow pipe, respectively.

Further, a pressure control valve may be provided in the seawater flow pipe to increase a pressure of seawater flowing through the seawater flow pipe.

In addition, the gas treatment unit may further include a microbubble generator provided in the seawater flow pipe to be connected to the gas recovery pipe.

Further, a plurality of micropores may be formed in the microbubble generator.

In addition, the gas treatment unit may further include a gas mixer provided in a portion of the seawater flow pipe, next to the microbubble generator, in a flow direction of the seawater, to mix the seawater and the emission-regulated gas.

Further, in the gas/liquid separation treatment liquid regeneration unit, a gas/liquid separation membrane through which the emission-regulated gas can pass but the waste treatment liquid cannot pass may partition a liquid flow path through which the waste treatment liquid flows and a gas flow path through which the emission-regulated gas flows, and a low partial pressure of the emission-regulated gas may be formed in the gas flow path such that the emission-regulated gas included in the waste treatment liquid of the liquid flow path passes through the gas/liquid separation membrane to move to the gas flow path.

In addition, a treatment liquid supply tank supplying the treatment liquid to the gas/liquid reactor and storing the treatment liquid regenerated in the gas/liquid separation treatment liquid regeneration unit may be further included.

Advantageous Effects

As described above, according to an embodiment of the present disclosure, a waste treatment liquid may be regenerated by a gas/liquid separation treatment liquid regeneration unit separating an emission-regulated gas from the waste treatment liquid which has treated exhaust gas.

In addition, according to an embodiment of the present disclosure, a regeneration rate of a waste treatment liquid which has treated exhaust gas may increase.

Further, according to an embodiment of the present disclosure, costs for treating exhaust gas in an exhaust gas treatment apparatus may be reduced.

In addition, according to an embodiment of the present disclosure, a size of an exhaust gas treatment apparatus may be reduced.

Further, according to an embodiment of the present disclosure, an emission-regulated gas may be separated from a waste treatment liquid in which the emission-regulated gas included in the exhaust gas is absorbed, and the separated emission-regulated gas may be treated by dissolving the emission-regulated gas in seawater in an eco-friendly ion state.

DESCRIPTION OF DRAWINGS

FIG. 1 is a view illustrating a first embodiment of an exhaust gas treatment apparatus according to the present disclosure.

FIG. 2 is a view illustrating another example of a gas/liquid separation treatment liquid regeneration unit of a first embodiment of an exhaust gas treatment apparatus according to the present disclosure.

FIG. 3 is a view illustrating an example of a gas treatment unit of a first embodiment of an exhaust gas treatment apparatus according to the present disclosure.

FIG. 4 is a view illustrating another example of a gas treatment unit of a first embodiment of an exhaust gas treatment apparatus according to the present disclosure.

FIG. 5 is a view illustrating a second embodiment of an exhaust gas treatment apparatus according to the present disclosure.

FIG. 6 is a view illustrating a third embodiment of an exhaust gas treatment apparatus according to the present disclosure.

FIG. 7 is a view illustrating a fourth embodiment of an exhaust gas treatment apparatus according to the present disclosure.

MODE FOR INVENTION

In order to help understand the features of the present invention as described above, an exhaust gas treatment apparatus for treating exhaust gas will be described in more detail below.

Hereinafter, embodiments most appropriate to help in an understanding of the technical features of the present invention will be described, the technical features of the present invention are not limited by the described embodiments and merely illustrate the implementation of the present invention through the embodiments described hereinafter. Thus, the present invention can be variably modified within the scope of the present invention through the embodiments described below, and such modifications are within the scope of the present invention. In order to help understand the embodiments described hereinafter, the like or similar reference numerals are used for relevant components among the components having the same function in the respective embodiments in the accompanying drawings.

First Embodiment of Exhaust Gas Treatment Apparatus

Hereinafter, a first embodiment of an exhaust gas treatment apparatus according to the present disclosure will be described with reference to FIGS. 1 to 4.

FIG. 1 is a view illustrating a first embodiment of an exhaust gas treatment apparatus according to the present disclosure, and FIG. 2 is a view illustrating another example of a gas/liquid separation treatment liquid regeneration unit of a first embodiment of an exhaust gas treatment apparatus according to the present disclosure.

FIG. 3 is a view illustrating an example of a gas treatment unit of a first embodiment of an exhaust gas treatment apparatus according to the present disclosure, and FIG. 4 is a view illustrating another example of a gas treatment unit of a first embodiment of an exhaust gas treatment apparatus according to the present disclosure.

A first embodiment of an exhaust gas treatment apparatus according to the present disclosure may include a gas/liquid reactor 200, a treatment liquid supply tank 300, and a gas/liquid separation treatment liquid regeneration unit 400.

Exhaust gas discharged from an exhaust gas discharge device (not illustrated) such as an engine, a boiler, or the like may introduced into and flow in the gas/liquid reactor 200. In addition, the gas/liquid reactor 200 may contact the exhaust gas and a treatment liquid to absorb and remove an emission-regulated gas included in the exhaust gas by the treatment liquid. The emission-regulated gas may be, for example, sulfur oxide or carbon dioxide. Any kind of gases which emission to the atmosphere and should be regulated may be provided as the emission-regulated gas, such as nitrogen oxides. The gas/liquid reactor 200 may include a housing 210 and a treatment liquid spraying unit 220.

The housing 210 may be connected to the exhaust gas discharge device. The housing 210 may be provided with an inlet 211, an outlet 212, and a drain 213. As illustrated in FIG. 1, the inlet 211 may be provided on a lower side surface of the housing 210, the outlet 212 may be provided on an upper surface of the housing 210, and the drain 213 may be provided on a lower surface of the housing 210. A portion of the housing 210 in which the inlet 211, the outlet 212, or the drain 213 is provided is not particularly limited.

The inlet 211 may be connected to the exhaust gas discharge device. Therefore, the exhaust gas discharged from the exhaust gas discharge device may be introduced into the housing 210 through the inlet 211 as illustrated in FIG. 1, and may flow in the housing 210.

The treatment liquid may be sprayed into the housing 210 by the treatment liquid spraying unit 220, as illustrated in FIG. 1. Therefore, the exhaust gas introducing into and flowing in the housing 210 may be in contact with the treatment liquid. In this manner, when the exhaust gas is in contact with the treatment liquid, the emission-regulated gas included in the exhaust gas, such as sulfur oxide or carbon dioxide, may be absorbed by the treatment liquid, and may be removed from the exhaust gas. The exhaust gas from which the emission-regulated gas has been removed may be discharged through the outlet 212. In addition, the waste treatment liquid, which may be a treatment liquid in which the emission-regulated gas is absorbed, may be drained through the drain 213.

A packing 230 may be provided in the housing 210. The packing 230 may increase a contact area and a contact time between the exhaust gas and the treatment liquid. Therefore, treatment efficiency of the exhaust gas by the treatment liquid may be improved. The packing 230 may include a plurality of members having a plurality of holes formed therein. Instead of the packing 230, a configuration in which the contact area and the contact time between the exhaust gas and the treatment liquid increase, such as the packing 230, may be provided in the housing 210.

The housing 210 may have a rectangular cross-section. The housing 210 may be installed in a funnel (not illustrated) of, for example, a ship (not illustrated). The funnel of the ship may have a rectangular cross-section. In addition, as described above, if the housing 210 has a rectangular cross-section, when the housing 210 is installed in the funnel of the ship, having a rectangular cross-section, a dead area, a space that cannot be used, may be minimized. When the housing 210 is installed in the funnel of the ship, the funnel may be extended, for example, in a direction facing a bow or a stern of the ship. When a cross-section of the housing 210 has a rectangular shape, the dead area may be minimized when installed in the funnel of the ship having a rectangular cross-section as described above, such that an expanded area of the funnel for installation of the housing 210 may be minimized. Therefore, the housing 210 may easily be installed in the funnel of the ship, time, materials, and the like for installation of the housing 210 in the funnel may be saved, and utilization of a space of the ship may be improved.

The treatment liquid spraying unit 220 may spray the treatment liquid into the exhaust gas flowing in the housing 210. The treatment liquid spraying unit 220 may include a treatment liquid flow pipe 221 and a treatment liquid spraying nozzle 222.

The treatment liquid flow pipe 221 may be connected to the treatment liquid supply tank 300. The treatment liquid flow pipe 221 may be connected to the treatment liquid supply tank 300 by a treatment liquid supply pipe LP, as illustrated in FIG. 1. A treatment liquid supply pump PP may be provided in the treatment liquid supply pipe LP. In addition, when the treatment liquid supply pump PP is driven, the treatment liquid stored in the treatment liquid supply tank 300 may flow through the treatment liquid flow pipe 221.

The treatment liquid flow pipe 221 may pass through one surface of the housing 210, and may be provided in the housing 210. In addition, the treatment liquid spraying nozzle 222 may be provided in a portion of the treatment liquid flow pipe 221 provided in the housing 210. Therefore, the treatment liquid flowing through the treatment liquid flow pipe 221 may be sprayed into the exhaust gas flowing in the housing 210 through the treatment liquid spraying nozzle 222, as illustrated in FIG. 1.

The treatment liquid supply tank 300 may supply the treatment liquid to the gas/liquid reactor 200. The treatment liquid may be stored in the treatment liquid supply tank 300. The treatment liquid stored in the treatment liquid supply tank 300 may be, for example, seawater, or an alkaline aqueous solution such as an aqueous sodium hydroxide solution or the like. However, the treatment liquid stored in the treatment liquid supply tank 300 is not particularly limited, and the treatment liquid may be any of the well-known things as long as it can be sprayed into the exhaust gas to be in contact with the exhaust gas and absorb the emission-regulated gas included in the exhaust gas, and it can be regenerated by separating the emission-regulated gas from it in the gas/liquid separation treatment liquid regeneration unit 400.

One side of the treatment liquid supply pipe LP may be connected to the treatment liquid supply tank 300, as illustrated in FIG. 1. The other side of the treatment liquid supply pipe LP may be connected to the treatment liquid flow pipe 221 of the treatment liquid spraying unit 220. In addition, when the treatment liquid supply pump PP of the treatment liquid supply pipe LP is driven, the treatment liquid in the treatment liquid supply tank 300 may be supplied to the treatment liquid spraying unit 220 through the treatment liquid supply pipe LP.

One side of a treatment liquid recovery pipe LR may be connected to the treatment liquid supply tank 300. The other side of the treatment liquid recovery pipe LR may be connected to the gas/liquid separation treatment liquid regeneration unit 400. In addition, the treatment liquid regenerated in the gas/liquid separation treatment liquid regeneration unit 400 may be supplied to and stored in the treatment liquid supply tank 300, through the treatment liquid recovery pipe LR, as illustrated in FIG. 1.

As illustrated in FIG. 1, a treatment agent supply tank 600 may be connected to the treatment liquid recovery pipe LR by a treatment agent supply pipe LT. Therefore, a treatment agent stored in the treatment agent supply tank 600, for example, an alkali agent such as sodium hydroxide, may be supplied to the regenerated treatment liquid flowing in the treatment liquid recovery pipe LR through the treatment agent supply pipe LT. In addition, the treatment agent supply pipe LT may be connected to the treatment liquid supply tank 300, not the treatment liquid recovery pipe LR, as illustrated in FIG. 5, to supply the treatment agent stored in the treatment agent supply tank 600 to the treatment liquid stored in the treatment liquid supply tank 300.

A heat exchanger HE may be connected to the treatment liquid supply tank 300, as illustrated in FIG. 1. The heat exchanger HE may heat exchange with the treatment liquid stored in the treatment liquid supply tank 300, to cool the treatment liquid to a temperature capable of relatively well absorbing the emission-regulated gas included in the exhaust gas. The treatment liquid may absorb the emission-regulated gas included in the exhaust gas in the gas/liquid reactor 200 to become a waste treatment liquid, and a temperature thereof may increase by the exhaust gas having a high temperature. In this manner, when the waste treatment liquid of which temperature is higher than a temperature of the treatment liquid before being sprayed into the gas/liquid reactor 200 is regenerated in the gas/liquid separation treatment liquid regeneration unit 400, a temperature of a regenerated treatment liquid may be also higher than a temperature of the treatment liquid before being sprayed into the gas/liquid reactor 200. When the treatment liquid of which temperature increased in this manner is supplied to the treatment liquid supply tank 300, a temperature of the treatment liquid stored in the treatment liquid supply tank 300 may increase, to reduce an absorption rate of the emission-regulated gas of the treatment liquid. However, as described above, when a temperature of the treatment liquid stored in the treatment liquid supply tank 300 is cooled by the heat exchanger HE to a temperature capable of relatively well absorbing the emission-regulated gas included in the exhaust gas, an absorption rate of the emission-regulated gas of the treatment liquid may not be lowered.

The gas/liquid separation treatment liquid regeneration unit 400 may separate the emission-regulated gas from the waste treatment liquid which is a treatment liquid having absorbed the emission-regulated gas and drained from the gas/liquid reactor 200, may regenerate the waste treatment liquid as a treatment liquid, and may supply the regenerated treatment liquid to the treatment liquid supply tank 300. In this manner, since the treatment liquid may be regenerated and reused, costs required to treat the exhaust gas may be reduced.

As illustrated in FIG. 1, one side of a waste treatment liquid drain pipe LD may be connected to the drain 213 of the gas/liquid reactor 200, and the other side of the waste treatment liquid drain pipe LD may be connected to the gas/liquid separation treatment liquid regeneration unit 400. Therefore, the waste treatment liquid drained through the drain 213 of the gas/liquid reactor 200 may flow to the gas/liquid separation treatment liquid regeneration unit 400 through the waste treatment liquid drain pipe LD. In this case, a booster pump PB may be provided in the waste treatment liquid drain pipe LD, as illustrated in FIG. 4.

The waste treatment liquid drain pipe LD may be provided with a filtration treatment unit WTS that filters and treats pollutants excluding the emission-regulated gas, included in the waste treatment liquid, as illustrated in FIG. 1. The pollutants excluding the emission-regulated gas, included in the waste treatment liquid may include particulate materials, oil, or the like. The filtration treatment unit WTS may filter the pollutants excluding the emission-regulated gas included in the waste treatment liquid flowing to the gas/liquid separation treatment liquid regeneration unit 400 through the waste treatment liquid drain pipe LD. Therefore, for example, particulate materials, oil, or the like included in the waste treatment liquid may be filtered by the filtration treatment unit WTS, to minimize amounts of the pollutants included in the treatment liquid regenerated in the gas/liquid separation treatment liquid regeneration unit 400. Therefore, performance of a gas/liquid separation membrane 420 included in the gas/liquid separation treatment liquid regeneration unit 400 may be protected. The filtration treatment unit WTS may filter particulate material, oil, or the like from the waste treatment liquid using, for example, a filter (not illustrated), centrifugal force, or the like. A configuration in which the filtration treatment unit WTS filters particulate material, oil, or the like from the waste treatment liquid is not particularly limited, and any known configuration may be used.

As illustrated in FIG. 1, one side of the treatment liquid recovery pipe LR may be connected to the gas/liquid separation treatment liquid regeneration unit 400, and the other side of the treatment liquid recovery pipe LR may be connected to the treatment liquid supply tank 300. Therefore, the treatment liquid regenerated in the gas/liquid separation treatment liquid regeneration unit 400 may be supplied to the treatment liquid supply tank 300 through the treatment liquid recovery pipe LR, and may be reused as a treatment liquid.

The gas/liquid separation treatment liquid regeneration unit 400 may include the gas/liquid separation membrane 420 passing a gas but not passing a liquid, and the gas/liquid separation membrane 420 may partition a liquid flow path 411 through which the waste treatment liquid flows and a gas flow path 412 through which the emission-regulated gas flows. The emission-regulated gas may pass through the gas/liquid separation membrane 420 of the present disclosure, but the waste treatment liquid may not pass through the gas/liquid separation membrane 420.

In addition, a low partial pressure of the emission-regulated gas may be formed in the gas flow path 412, such that the emission-regulated gas absorbed in the waste treatment liquid flows through the liquid flow path 411 and passes through the gas/liquid separation membrane 420, and moves to the gas flow path 412 in which a low partial pressure of the emission-regulated gas is formed, to separate the emission-regulated gas and the treatment liquid. A low partial pressure of the emission-regulated gas may refer to a state in which a concentration of the emission-regulated gas is low. When carbon dioxide of the emission-regulated gas is described as an example, a concentration of the carbon dioxide may be low in the gas flow path 412 and a low partial pressure of the carbon dioxide may be formed. Since the lower the partial pressure, the lower the solubility of the gas in the liquid, the emission-regulated gas absorbed in the waste treatment liquid flows through the liquid flow path 411 and passes through the gas/liquid separation membrane 420, to move to the gas flow path 412 in which a low partial pressure of the emission-regulated gas is formed. A negative pressure may be applied to create a low partial pressure of the emission-regulated gas, or the emission-regulated gas may be diluted with sweeping air. In this manner, the emission-regulated gas absorbed in the waste treatment liquid may flow through the liquid flow path 411, may pass through the gas/liquid separation membrane 420, and may move to the gas flow path in which a low partial pressure of the emission-regulated gas is formed, to easily separate the emission-regulated gas from the waste treatment liquid.

The gas/liquid separation membrane 420 through which a gas can pass but a liquid cannot pass may be used, and a low partial pressure of the emission-regulated gas may be formed in the gas flow path 412 partitioned by the gas/liquid separation membrane 420, to separate the emission-regulated gas from the waste treatment liquid. Therefore, the waste treatment liquid may be regenerated as a treatment liquid in which the emission-regulated gas is not absorbed. In using such a method, since an amount of the treatment agent to be supplied to the regenerated treatment liquid may be reduced, costs required to regenerate the waste treatment liquid may be reduced. Therefore, costs required to treat the exhaust gas may be reduced. In addition, since a size of the gas/liquid separation treatment liquid regeneration unit 400 may be made relatively small, a size of the exhaust gas treatment apparatus 100 may be reduced. Therefore, the exhaust gas treatment apparatus 100 may be easily installed in a place in which an installation space is limited, such as a ship.

The gas/liquid separation treatment liquid regeneration unit 400 may be configured to include a separation unit body 410 as illustrated in FIG. 1. An internal space of the separation unit body 410 may be divided into the liquid flow path 411 and the gas flow path 412 by the gas/liquid separation membrane 420.

As illustrated in FIG. 1, the waste treatment liquid drain pipe LD connected to the drain 213 of the gas/liquid reactor 200 may be connected to one side of the liquid flow path 411, and the other side of the liquid flow path 411 may be connected to the treatment liquid supply tank 300 by the liquid recovery pipe LR. Therefore, the waste treatment liquid drained through the drain 213 of the gas/liquid reactor 200 may be introduced into the liquid flow path 411 to flow through the liquid flow path 411. While flowing through the liquid flow path 411, the emission-regulated gas may be separated and the regenerated treatment liquid may be introduced into the treatment liquid recovery pipe LR and flow to the treatment liquid supply tank 300 through the treatment liquid recovery pipe LR.

A gas recovery pipe LG provided with a vacuum pump PV may be connected to one side of the gas flow path 412, as illustrated in FIG. 1. Therefore, when the vacuum pump PV is driven, a low partial pressure of the emission-regulated gas may be formed in the gas flow path 412. In addition, an air inlet pipe LA provided with a flow control valve VC may be connected to the other side of the gas flow path 412. Thereby, in a state in which the vacuum pump PV is driven, the flow control valve VC may be operated to control a flow rate of air flowing into the air inlet pipe LA, to adjust a low partial pressure of the emission-regulated gas formed in the gas flow path 412.

The gas/liquid separation membrane 420 may be a hollow fiber membrane in which the gas flow path 412 may be formed, as illustrated in FIG. 1. Therefore, an internal space of the separation unit body 410, other than the gas/liquid separation membrane 420, may form the liquid flow path 411. In addition, the gas/liquid separation membrane 420 may be a hollow fiber membrane in which the liquid flow path 411 may be formed, as illustrated in FIG. 2. In this case, an internal space of the separation unit body 410, other than the gas/liquid separation membrane 420, may be the gas flow path 412. The gas/liquid separation membrane 420 is not particularly limited, and the gas/liquid separation membrane 420 may be any of the well-known things such as flat membranes as long as the emission-regulated gas can pass through it but the waste treatment liquid cannot pass through it, and it can partition the internal space of separation unit body 410 into the liquid flow path 411 through which the waste treatment liquid flows and the gas flow path 412 through which the emission-regulated gas flows.

When high sulfur fuel is used in the exhaust gas discharge device, a relatively large amount of sulfur oxide may be included in the exhaust gas discharged from the exhaust gas discharge device. As such, when the exhaust gas containing a large amount of sulfur oxide flows into the housing 210 of the gas/liquid reactor 200, the treatment liquid sprayed into the exhaust gas by the treatment liquid spraying unit 220 may mainly remove the sulfur oxide included in the exhaust gas, from the exhaust gas. That is, the exhaust gas may be desulfurized by the treatment liquid in the gas/liquid reactor 200. As described above, the waste treatment liquid removing the sulfur oxide from the exhaust gas may include the sulfur oxide, and the gas/liquid separation treatment liquid regeneration unit 400 may separate the emission-regulated gas, which may be sulfur oxide such as sulfur dioxide or the like, from the waste treatment liquid.

When low sulfur fuel is used in the exhaust gas discharge device, a relatively small amount of sulfur oxide may be included in the exhaust gas discharged from the exhaust gas discharge device. As such, when the exhaust gas containing a small amount of sulfur oxide flows into the housing 210 of the gas/liquid reactor 200, the treatment liquid sprayed into the exhaust gas by the treatment liquid spraying unit 220 may mainly remove carbon dioxide included in the exhaust gas, from the exhaust gas. As described above, the waste treatment liquid removing the carbon dioxide from the exhaust gas may include the carbon dioxide, and the gas/liquid separation treatment liquid regeneration unit 400 may separate the carbon dioxide, from the waste treatment liquid.

The first embodiment of the exhaust gas treatment apparatus 100 according to the present disclosure may further include a gas treatment unit 500. The gas treatment unit 500 may treat the emission-regulated gas separated from the waste treatment liquid in the gas/liquid separation treatment liquid regeneration unit 400.

In the gas treatment unit 500, the emission-regulated gas may be dissolved and treated in seawater in an eco-friendly ion state. For example, in the gas treatment unit 500, as the emission-regulated gas, carbon dioxide may be dissolved and treated in seawater in a state of natural eco-friendly ionized substances such as carbonic acid, bicarbonate, carbonate, or the like, and sulfur oxide may be dissolved and treated in seawater in a state of natural eco-friendly ionized substances such as sulfuric acid, sulfate, or the like.

To this end, the gas treatment unit 500 may include a seawater flow pipe 510 through which the seawater flows and to which a gas recovery pipe LG connected to the gas/liquid separation treatment liquid regeneration unit 400 is connected, as illustrated in FIG. 3. The seawater flow pipe 510 may be, for example, a cooling water pipe, a ballast water pipe, a sea chest, or the like, provided in a ship. The seawater flow pipe 510 is not particularly limited, and any known pipe may be used as long as seawater flows therethrough.

A portion of the seawater flow pipe 510 to which the gas return pipe LG is connected may be branched as a plurality of branched portions, as illustrated in FIG. 3. In addition, the gas recovery pipe LG may be branched and connected to the branched portions of the seawater flow pipe 510, respectively.

As described above, when the seawater flow pipe 510 has the plurality of branched portions, since a flow rate of seawater may decrease, to secure sufficient time for the emission-regulated gas to be dissolved in the seawater in an eco-friendly ion state, the emission-regulated gas may be better dissolved in the seawater in an eco-friendly ion state. In addition, as illustrated in FIG. 3, a pressure control device VCP may be provided in the seawater flow pipe 510. Thereby, a pressure of seawater flowing through the seawater flow pipe 510 may increase to easily dissolve the emission-regulated gas in seawater in an eco-friendly ion state.

The gas treatment unit 500 may further include a microbubble generator 520 provided in the seawater flow pipe 510 to be connected to the gas recovery pipe LG, as illustrated in FIG. 3. In the microbubble generator 520, the emission-regulated gas may be mixed with seawater flowing through the seawater flow pipe 510 as microbubbles. For example, a plurality of micropores 521 may be formed in the microbubble generator 520, such that the emission-regulated gas flowing through the gas recovery pipe LG passes through the micropores 521 to be mixed with the seawater flowing through the seawater flow pipe 510 as microbubbles. In this manner, when the emission-regulated gas is mixed with the seawater flowing through the seawater flow pipe 510 as microbubbles, the emission-regulated gas may be better dissolved in the seawater in an eco-friendly ionic state.

The gas treatment unit 500 may further include a gas mixer 530. The gas mixer 530 may be provided in a portion of the seawater flow pipe 510, next to the microbubble generator 520, in a flow direction of the seawater, as illustrated in FIG. 3. In addition, bubbles of the emission-regulated gas generated in the microbubble generator 520 and supplied to the seawater flowing through the seawater flow pipe 510 may be mixed with the seawater. For example, the gas mixer 530 may be provided to rotate a mixing member 531 having a screw shape and to mix the emission-regulated gas bubbles supplied to seawater of the seawater flow pipe 510 and the seawater. Therefore, the emission-regulated gas may be better dissolved in the seawater in an eco-friendly ionic state.

As described above, the branched portions of the seawater flow pipe 510 may be again combined and connected to sea SEA, as illustrated in FIG. 3. Therefore, seawater in which the emission-regulated gas is dissolved in an eco-friendly ionic state may be drained into the sea SEA. As illustrated in FIG. 3, a water quality measurement sensor SP may be provided in a portion of the seawater flow pipe 510 for discharging the seawater in which the emission-regulated gas is dissolved in an environment-friendly ionic state, into the sea.

In addition, the gas treatment unit 500 may dissolve and treat the emission-regulated gas in fresh water flowing through a fresh water flow pipe (not illustrated) in an eco-friendly ion state.

The gas treatment unit 500 may store and treat the emission-regulated gas separated from the waste treatment liquid in the gas/liquid separation treatment liquid regeneration unit 400. In some areas of the sea SEA, a no-discharge condition in which no material should be discharged from a ship or the like may be required. Therefore, in a ship running such an area, the gas treatment unit 500 may store the emission-regulated gas separated from the waste treatment liquid in the gas/liquid separation treatment liquid regeneration unit 400. In this manner, the emission-regulated gas stored in the gas treatment unit 500 may be supplied to a place of use.

As illustrated in FIG. 4, a gas treatment unit 500 may include a gas storage tank 540 to which a gas recovery pipe LG is connected to store an emission-regulated gas.

An emission-regulated gas separated from a waste treatment liquid in a gas/liquid separation treatment liquid regeneration unit 400 may be stored in the gas storage tank 540 through the gas recovery pipe LG. In the gas storage tank 540, the emission-regulated gas may be cooled and compressed to liquefy the emission-regulated gas, to store the emission-regulated gas in a liquid state. In this manner, the emission-regulated gas stored in a liquid state in the gas storage tank 540 may be supplied to a place of use.

Second Embodiment of Exhaust Gas Treatment Apparatus

Hereinafter, a second embodiment of an exhaust gas treatment apparatus according to the present disclosure will be described with reference to FIG. 5.

FIG. 5 is a view illustrating a second embodiment of an exhaust gas treatment apparatus according to the present disclosure.

In this case, a second embodiment of an exhaust gas treatment apparatus according to the present disclosure may be different from the first embodiment of the exhaust gas treatment apparatus according to the present disclosure described with reference to FIGS. 1 to 4 above, in view of the facts that sulfur oxide included in exhaust gas from a gas/liquid reactor 200 may be absorbed and removed by a first treatment liquid, and carbon dioxide included in exhaust gas from which the sulfur oxide is removed may be absorbed and removed by a second treatment liquid. For this purpose, there may be differences in view of the facts that a first removal region RR1 in which the exhaust gas and the first treatment liquid are in contact to remove the sulfur oxide, a second removal region RR2 in which the exhaust gas and the second treatment liquid are in contact to remove the carbon dioxide, and a connection region RC connecting the first removal region RR1 and the second removal region RR2 are provided in the gas/liquid reactor 200.

Therefore, hereinafter, the differences will be mainly described, and remaining configurations may be replaced with those described with reference to FIGS. 1 to 4.

In a gas/liquid reactor 200 of the second embodiment of the exhaust gas treatment apparatus 100 according to the present disclosure, sulfur oxide included in exhaust gas may be absorbed and removed by a first treatment liquid, and carbon dioxide included in the exhaust gas from which the sulfur oxide is removed may be absorbed and removed by a second treatment liquid.

When a treatment liquid, for example an alkaline aqueous solution, is sprayed into exhaust gas containing both sulfur oxide and carbon dioxide, the sulfur oxide may be first removed from the exhaust gas. Therefore, in order to remove the carbon dioxide from the exhaust gas, the sulfur oxide included in the exhaust gas should be removed first. As described above, when the first treatment liquid absorbs and removes the sulfur oxide included in the exhaust gas, and the second treatment liquid absorbs and removes the carbon dioxide included in the exhaust gas from which the sulfur oxide are removed, all the sulfur oxide and the carbon dioxide may be removed from the exhaust gas. In addition, even when the exhaust gas includes a small amount of the sulfur oxide, since the sulfur oxide may be removed first, a removal rate of the carbon dioxide may be further improved.

A first removal region RR1 in which the exhaust gas and the first treatment liquid are in contact to remove the sulfur oxide, a second removal region RR2 in which the exhaust gas and the second treatment liquid are in contact to remove the carbon dioxide, and a connection region RC connecting the first removal region RR1 and the second removal region RR2 may be provided in the gas/liquid reactor 200.

To this end, a housing 210 of the gas/liquid reactor 200 may be divided into the first removal region RR1, the second removal region RR2, and the connection region RC by a plurality of partition walls WD, as illustrated in FIG. 5.

In this case, the plurality of partition walls WD may be provided in the housing 210 such that the exhaust gas flows from the bottom to the top in the first removal region RR1 and the second removal region RR2, and the exhaust gas flows from the top to the bottom in the connection region RC.

For example, as illustrated in FIG. 5, two (2) partition walls WD may be provided in the housing 210, respectively, such that an internal space of the housing 210 may be divided into the first removal region RR1, the second removal region RR2, and the connection region RC. For example, one partition wall WD may partition the internal space of the housing 210 into the first removal region RR1 and a portion of the connection region RC, and the other partition wall WD may partition the internal space of the housing 210 into the second removal region RR2 and remainder of the connection region RC.

In addition, the partition wall WD partitioning the first removal region RR1 and the portion of the connection region RC may have an upper end portion in the internal space of the housing 210 to be spaced apart from an upper end portion of the housing 210 in a predetermined distance, as illustrated in FIG. 5. In addition, the partition wall WD partitioning the second removal region RR2 and the remainder of the connection region RC may have a lower end portion in the internal space of the housing 210 to be spaced apart from a lower end portion of the housing 210 in a predetermined distance.

In addition, an inlet 211 connected to an exhaust gas discharge device may be connected to the first removal region RR1, and an outlet 212 may be connected to the second removal region RR2. In addition, the housing 210 may be provided with a first drain 213' and a second drain 213", respectively, and the first drain 213' may be connected to the first removal region RR1 and the second drain 213" may be connected to the second removal region RR2.

Therefore, the exhaust gas may flow from the bottom to the top in both the first removal region RR1 and the second removal region RR2, to remove sulfur oxide or carbon dioxide, and the exhaust gas from which the sulfur oxide is removed in the first removal region RR1 may flow from the top to the bottom in the connection region RC, to be introduced into the second removal region RR2.

In addition, a gas/liquid separation treatment liquid regeneration unit 400 may include a pretreatment configuration and a treatment liquid recovery configuration, connected to the gas/liquid separation treatment liquid regeneration unit 400 for regeneration of a waste treatment liquid, and a configuration connected to a gas recovery pipe for separating the carbon dioxide.

The gas/liquid reactor 200 of the second embodiment of the exhaust gas treatment apparatus 100 according to the present disclosure may include a first treatment liquid spraying unit 220' and a second treatment liquid spraying unit 220", as illustrated in FIG. 5.

The first treatment liquid spraying unit 220' may spray a first treatment liquid into the exhaust gas flowing through the first removal region RR1 of the housing 210. The first treatment liquid spraying unit 220' may include a first treatment liquid flow pipe 221' and a first treatment liquid spraying nozzle 222', as illustrated in FIG. 5.

The first treatment liquid flow pipe 221' may pass through one surface of the housing 210, and may be provided in the first removal region RR1. In addition, the first treatment liquid spraying nozzle 222' may be provided in a portion of the first treatment liquid flow pipe 221' provided in the first removal region RR1.

The first treatment liquid spraying unit 220' may be provided as a plurality of first treatment liquid spraying units 220'. In this case, the plurality of first treatment liquid spraying units 220' may be arranged vertically at predetermined intervals. In addition, a first treatment liquid spraying unit 220' on the bottom may perform pre-treatment of removing a portion of the sulfur oxide from the exhaust gas while cooling a temperature of the exhaust gas by the first treatment liquid to facilitate removal of the sulfur oxide and the carbon dioxide. In addition, a remaining portion of the first treatment liquid spraying unit 220' may perform post-treatment to remove residual portion of the sulfur oxide from the exhaust gas. For example, as illustrated in FIG. 5, there may be two first treatment liquid spraying units 220'. The number of the first treatment liquid spraying units 220' is not particularly limited, and any number may be used.

The first treatment liquid may be seawater. In this case, as illustrated in FIG. 5, a first treatment liquid supply pipe LP' connected to sea SEA may be connected to the first treatment liquid flow pipe 221' of the first treatment liquid spraying unit 220'. A first treatment liquid supply pump PP' may be provided in the first treatment liquid supply pipe LP'. In addition, a first waste treatment liquid drain pipe LD' connected to the sea SEA may be connected to the first drain 213' connected to the first removal region RR1 of the housing 210.

Therefore, when the first treatment liquid supply pump PP' is driven, seawater may flow through the first treatment liquid flow pipe 221' of the first treatment liquid spraying unit 220' as the first treatment liquid, to be sprayed into the exhaust gas flowing through the first removal region RR1 of the housing 210, by the first treatment liquid spraying nozzle 222'. In addition, a first waste treatment liquid, which may be seawater sprayed into the first removal region RR1 of the housing 210 and in which the sulfur oxide is absorbed from the exhaust gas, may be drained to the sea SEA through the first waste treatment liquid drain pipe LD'. A water treatment unit (not illustrated) may be provided in the first waste treatment liquid drainpipe LD', to water-treat the first waste treatment liquid, which may be seawater in which the sulfur oxide is absorbed from the exhaust gas, and then discharge the water-treated first waste treatment liquid to the sea SEA.

The second treatment liquid spraying unit 220" may spray a second treatment liquid into the exhaust gas flowing through the second removal region RR2 of the housing 210. The second treatment liquid spraying unit 220" may include a second treatment liquid flow pipe 221" and a second treatment liquid spraying nozzle 222", as illustrated in FIG. 5.

The second treatment liquid flow pipe 221" may pass through the other surface of the housing 210 and be provided in the second removal region RR2. The second treatment liquid spraying nozzle 222" may be provided in a portion of the second treatment liquid flow pipe 221" provided in the second removal region RR2.

In a treatment liquid supply tank 300 of the second embodiment of the exhaust gas treatment apparatus 100 according to the present disclosure, the second treatment liquid may be supplied to the gas/liquid reactor 200. To this end, the second treatment liquid may be stored in the treatment liquid supply tank 300, and a second treatment liquid supply pipe LP" connected to the treatment liquid supply tank 300 may be connected to the treatment liquid flow pipe 221" of the second treatment liquid spraying unit 220".

A second treatment liquid supply pump PP" may be provided in the second treatment liquid supply pipe LP". When the second treatment liquid supply pump PP" is driven, the second treatment liquid stored in the treatment liquid supply tank 300 may flow through the second treatment liquid flow pipe 221" of the second treatment liquid spraying unit 220", to be sprayed into the exhaust gas flowing through the second removal region RR2 of the housing 210 by the second treatment liquid spraying nozzle 222".

The second treatment liquid may be an alkaline aqueous solution such as an aqueous sodium hydroxide solution or the like.

The gas/liquid separation treatment liquid regeneration unit 400 of the second embodiment of the exhaust gas treatment apparatus 100 according to the present disclosure, may separate the carbon dioxide from a second waste treatment liquid drained from the gas/liquid reactor 200, which may be a second treatment liquid in which the carbon dioxide is absorbed, may regenerate the second waste treatment liquid as a second treatment liquid, and may supply the regenerated second treatment liquid to the treatment liquid supply tank 300.

To this end, the carbon dioxide can pass a gas/liquid separation membrane 420 of the gas/liquid separation treatment liquid regeneration unit 400 but the second waste treatment liquid cannot pass a gas/liquid separation membrane 420. In addition, a second waste treatment liquid drain pipe LD" connected to the gas/liquid reactor 200 may be connected to one side of a liquid flow path 411 of the gas/liquid separation treatment liquid regeneration unit 400. For example, as illustrated in FIG. 5, the second waste treatment liquid drain pipe LD" may be connected to the second drain 213" connected to the second removal region RR2 of the gas/liquid reactor 200, and the second waste treatment liquid drain pipe LD" may be connected to the one side of the liquid flow path 411 of the gas/liquid separation treatment liquid regeneration unit 400. In addition, the other side of the liquid flow path 411 may be connected to the treatment liquid supply tank 300 by a treatment liquid recovery pipe LR.

Therefore, while the second waste treatment liquid drained through the second drain 213" of the gas/liquid reactor 200 flows through the liquid flow path 411 of the gas/liquid separation treatment liquid regeneration unit 400 through the second waste treatment liquid drain pipe LD", the carbon dioxide may be separated from the second waste treatment liquid, and the second waste liquid may be regenerated as a second treatment liquid. The regenerated second treatment liquid may be supplied to the treatment liquid supply tank 300 through the treatment liquid recovery pipe LR.

In addition, the carbon dioxide separated from the second waste treatment liquid flowing through the liquid flow path 411 of the gas/liquid separation treatment liquid regeneration unit 400 and moved to a gas flow path 412 may flow to and be treated by the gas treatment unit 500 through a gas recovery pipe LG connected to the gas flow path 412.

Third Embodiment of Exhaust Gas Treatment Apparatus

Hereinafter, a third embodiment of an exhaust gas treatment apparatus according to the present disclosure will be described with reference to FIG. 6.

FIG. 6 is a view illustrating a third embodiment of an exhaust gas treatment apparatus according to the present disclosure.

In this case, a third embodiment of an exhaust gas treatment apparatus according to the present disclosure may be different from the second embodiment of the exhaust gas treatment apparatus according to the present disclosure described with reference to FIG. 5 above, in view of the facts that a treatment liquid supply tank 300 may supply a first treatment liquid and a second treatment liquid to a gas/liquid reactor 200, respectively, and a first gas/liquid separation treatment liquid regeneration unit 400' for regenerating a first waste treatment liquid as the first treatment liquid, and a second gas/liquid separation treatment liquid regeneration unit 400" for regenerating a second waste treatment liquid as the second treatment liquid may be included.

Therefore, hereinafter, the differences will be mainly described, and remaining configurations may be replaced with those described with reference to FIGS. 1 to 5.

A treatment liquid supply tank 300 of the third embodiment of the exhaust gas treatment apparatus 100 according to the present disclosure may supply a first treatment liquid and a second treatment liquid to a gas/liquid reactor 200, respectively.

To this end, an internal space of the treatment liquid supply tank 300 may be partitioned into a first storage region SS1 in which the first treatment liquid is stored, and a second storage region SS2 in which the second treatment liquid is stored, by a partition wall WD, as illustrated in FIG. 6.

In addition, the first storage region SS1 may be connected to a first treatment liquid spraying unit 220' of the gas/liquid reactor 200 by a first treatment liquid supply pipe LP', and the second storage region SS2 may be connected to a second treatment liquid spraying unit 220" of the gas/liquid reactor 200 by a second treatment liquid supply pipe LP".

Therefore, when a first treatment liquid supply pump PP' provided in the first treatment liquid supply pipe LP' is driven, the first treatment liquid in the first storage region SS1 may be supplied to the first treatment liquid spraying unit 220' through the first treatment liquid supply pipe LP'.

The first treatment liquid supplied to the first treatment liquid spraying unit 220' may be sprayed into the exhaust gas flowing through a first removal region RR1 of the gas/liquid reactor 200.

In addition, when a second treatment liquid supply pump PP" provided in the second treatment liquid supply pipe LP" is driven, the second treatment liquid in the second storage region SS2 may be supplied to the second treatment liquid spraying unit 220" through the second treatment liquid supply pipe LP". The second treatment liquid supplied to the second treatment liquid spraying unit 220" may be sprayed into the exhaust gas flowing through a second removal region RR2 of the gas/liquid reactor 200.

The first treatment liquid spraying unit 220' may be provided as a plurality of first treatment liquid spraying units 220', and a packing 230 may be provided in a portion of the first removal region RR1 between the plurality of first treatment liquid spraying units 220'. For example, as illustrated in FIG. 6, two (2) first treatment liquid spraying units 220' may be disposed vertically at a predetermined interval, and a packing 230 may be provided in a portion of the first removal region RR1 between the two (2) first treatment liquid spraying units 220'.

A first gas/liquid separation treatment liquid regeneration unit 400' may separate sulfur oxide from a first waste treatment liquid, which may be the first treatment liquid in which the sulfur oxide is absorbed, drained from the gas/liquid reactor 200, to regenerate the first waste treatment liquid as a first treatment liquid, and may supply the regenerated first treatment liquid to the treatment liquid supply tank 300.

To this end, in the first gas/liquid separation treatment liquid regeneration unit 400', a first gas/liquid separation membrane 420' through which the sulfur oxide can pass but the first waste treatment liquid cannot pass may partition a first liquid flow path 411' through which the first waste treatment liquid flows and a first gas flow path 412' through which the sulfur oxide flows. In addition, a low partial pressure of sulfur oxide may be formed in the first gas flow path 412', such that the sulfur oxide included in the first waste treatment liquid of the first liquid flow path 411' may move to the first gas flow path 412' by passing through the first gas/liquid separation membrane 420'.

The first gas/liquid separation treatment liquid regeneration unit 400' may further include a first separation unit body 410' of which an internal space is partitioned into the first liquid flow path 411' and the first gas flow path 412' by the first gas/liquid separation membrane 420'. In addition, a first waste treatment liquid drain pipe LD' connected to a first drain 213' of the gas/liquid reactor 200 may be connected to one side of the first liquid flow path 411', and the other side of the first liquid flow path 411' may be connected to the first storage region SS1 of the treatment liquid supply tank 300 by a first treatment liquid recovery pipe LR'. A first gas recovery pipe LG' provided with a vacuum pump PV may be connected to one side of the first gas flow path 412', such that a low partial pressure of the sulfur oxide may be formed in the first gas flow path 412'. In addition, a first air inlet pipe LA' provided with a flow control valve VC may be connected to the other side of the first gas flow path 412', to adjust a partial pressure of the sulfur oxide formed in the first gas flow path 412'. In addition, the first gas/liquid separation membrane 420' may be a hollow fiber membrane in which the first gas flow path 412' or the first liquid flow path 411' is formed.

A second gas/liquid separation treatment liquid regeneration unit 400" may separate carbon dioxide from a second waste treatment liquid, which may be the second treatment liquid in which the carbon dioxide is absorbed, drained from the gas/liquid reactor 200, to regenerate the second waste treatment liquid as a second treatment liquid, and may supply the regenerated second treatment liquid to the treatment liquid supply tank 300.

To this end, in the second gas/liquid separation treatment liquid regeneration unit 400", a second gas/liquid separation membrane 420" through which the carbon dioxide can pass but the second waste treatment liquid cannot pass may partition a second liquid flow 411" through which the second waste treatment liquid flows and the second gas flow path 412" through which the carbon dioxide flows. In addition, a low partial pressure of carbon dioxide may be formed in the second gas flow path 412", such that the carbon dioxide included in the second waste treatment liquid of the second liquid flow path 411" may move to the second gas flow path 412" by passing through the second gas/liquid separation membrane 420".

The second gas/liquid separation treatment liquid regeneration unit 400" may further include a second separation unit body 410" of which an internal space is partitioned into the second liquid flow path 411" and the second gas flow path 412" by the second gas/liquid separation membrane 420". In addition, a second waste treatment liquid drain pipe LD" connected to a second drain 213" of the gas/liquid reactor 200 may be connected to one side of the second liquid flow path 411", and the other side of the second liquid flow path 411" may be connected to the second storage region SS2 of the treatment liquid supply tank 300 by a second treatment liquid recovery pipe LR". In addition, a second gas recovery pipe LG" provided with a vacuum pump PV may be connected to one side of the second gas flow path 412", such that a low partial pressure of the carbon dioxide may be formed in the second gas flow path 412". In addition, a second air inlet pipe LA" provided with a flow control valve VC may be connected to the other side of the second gas flow path 412", to adjust a partial pressure of the carbon dioxide formed in the second gas flow path 412". In addition, the second gas/liquid separation membrane 420" may be a hollow fiber membrane in which the second gas flow path 412" or the second liquid flow path 411" is formed.

The first treatment liquid and the second treatment liquid may be an aqueous alkaline solution such as an aqueous sodium hydroxide solution or the like. In this case, an alkali agent such as sodium hydroxide or the like may be stored in a treatment agent supply tank 600, and the treatment agent supply tank 600 may be connected to the first storage region SS1 and the second storage region SS2 of the treatment liquid supply tank 300, respectively, such that the alkali agent may be respectively supplied as a treatment agent.

The first treatment liquid and the second treatment liquid may be different.

In addition, each of the first gas recovery pipe LG' and the second gas recovery pipe LG" may be connected to a gas treatment unit 500.

Fourth Embodiment of Exhaust Gas Treatment Apparatus

Hereinafter, a fourth embodiment of an exhaust gas treatment apparatus according to the present disclosure will be described with reference to FIG. 7.

FIG. 7 is a view illustrating a fourth embodiment of an exhaust gas treatment apparatus according to the present disclosure.

In this case, a fourth embodiment of an exhaust gas treatment apparatus according to the present disclosure may be different from the second and third embodiments of the exhaust gas treatment apparatus according to the present disclosure described with reference to FIGS. 5 and 6 above, in view of the facts that a cross-section of a housing 210 of a gas/liquid reactor 200 is circular or elliptical.

Therefore, hereinafter, the differences will be mainly described, and remaining configurations may be replaced with those described with reference to FIGS. 1 to 6.

In the fourth embodiment of the exhaust gas treatment apparatus 100 according to the present disclosure, a cross-section of a housing 210 of a gas/liquid reactor 200 may be circular or elliptical. Therefore, the housing 210 may be a cylinder or an elliptical cylinder, as illustrated in FIG. 7. A first removal region RR1 may be located on an outermost side in a radial direction inside the housing 210, a connection region RC may be located on inside of the first removal region RR1, and a second removal region RR2 may be located on inside of the connection region RC. To this end, cross-sections of the first removal region RR1 and the connection region RC may be annular, and a cross-section of the second removal region RR2 may be circular or elliptical. Therefore, since exhaust gas may flow smoothly but not flow biased in one direction, treatment of the exhaust gas may be performed more smoothly.

A plurality of partition walls WD, which may be cylindrical or elliptical, may be provided in the housing 210 to partition an internal space of the housing 210 into the first removal region RR1, the connection region RC, and the second removal region RR2. For example, as illustrated in FIG. 7, two (2) partition walls WD, which may be cylindrical or elliptical, may be provided in the housing 210 to partition an internal space of the housing 210 into the first removal region RR1, the connection region RC, and the second removal region RR2.

The plurality of partition walls WD may be provided in the housing 210 such that the exhaust gas flows from the bottom to the top in the first removal region RR1 and the second removal region RR2, and the exhaust gas flows from the top to the bottom in the connection region RC.

In the gas/liquid reactor 200 having the above-described configuration, the exhaust gas discharged from the exhaust gas discharge device may be first introduced into the first removal region RR1 formed on the outermost side in the radial direction in the housing 210 and connected to an inlet 211, through the inlet 211. Sulfur oxide may be removed by a first treatment liquid sprayed into the first removal region RR1 while the exhaust gas introduced into the first removal region RR1 flows through the first removal region RR1. The exhaust gas from which the sulfur oxide is removed may flow into the second removal region RR2 inside of the connection region RC through the connection region RC inside of the first removal region RR1. Carbon dioxide may be removed while the exhaust gas introduced into the second removal region RR2 flows through the second removal region RR2. The exhaust gas from which the carbon dioxide is removed may be discharged through an outlet 212 connected to the second removal region RR2.

As described above, when the exhaust gas treatment apparatus according to the present disclosure is used, a waste treatment liquid may be regenerated by a gas/liquid separation treatment liquid regeneration unit separating an emission-regulated gas from the waste treatment liquid which has treated exhaust gas, a regeneration rate of a waste treatment liquid which has treated exhaust gas may be increased, costs for treating exhaust gas in an exhaust gas treatment apparatus may be reduced, a size of an exhaust gas treatment apparatus may be reduced, and an emission-regulated gas may be separated from a waste treatment liquid gas in which the emission-regulated gas included in the exhaust gas is absorbed, and the separated emission-regulated gas may be treated by dissolving the emission-regulated gas in seawater in an eco-friendly ion state.

The exhaust gas treatment apparatus described above may not be limitedly applicable to the configurations of the above-described embodiments, but the embodiments may be configured by selectively combining all or portion of each of the embodiments such that various modifications are made.

While example embodiments have been illustrated and described above, it will be apparent to those skilled in the art that modifications and variations could be made without departing from the scope of the present disclosure as defined by the appended claims.

The invention claimed is:

1. An exhaust gas treatment apparatus comprising:

a gas/liquid reactor contacting a treatment liquid and an emission-regulated gas included in exhaust gas, to absorb and remove the emission-regulated gas;

a treatment liquid supply tank supplying the treatment liquid to the gas/liquid reactor; and a gas/liquid separation treatment liquid regeneration unit regenerating a waste treatment liquid in which the emission-regulated gas is absorbed, into a treatment liquid in which the emission-regulated gas is not absorbed, and supplying the regenerated treatment liquid to the treatment liquid supply tank, wherein the gas/liquid separation treatment liquid regeneration unit includes a gas/liquid separation membrane through which a gas can pass but a liquid cannot pass, wherein the gas/liquid separation membrane partitions a liquid flow path through which the waste treatment liquid flows and a gas flow path through which the emission-regulated gas flows, and the emission-regulated gas absorbed in the waste treatment liquid flows through the liquid flow path and passes through the gas/liquid separation membrane, and moves to the gas flow path in which a low partial pressure of the emission-regulated gas is formed, to separate the emission-regulated gas and the treatment liquid.

2. The exhaust gas treatment apparatus of claim 1, wherein a waste treatment liquid drain pipe connected to the gas/liquid reactor is connected to one side of the liquid flow path, and the other side of the liquid flow path is connected to the treatment liquid supply tank by a treatment liquid recovery pipe.

3. The exhaust gas treatment apparatus of claim 2, wherein the waste treatment liquid drain pipe comprises a filtration treatment unit filtering a pollutant, except for the emission-regulated gas included in the waste treatment liquid.

4. The exhaust gas treatment apparatus of claim 1, wherein a gas recovery pipe provided with a vacuum pump is connected to one side of the gas flow path, to form the low partial pressure of the emission-regulated gas in the gas flow path.

5. The exhaust gas treatment apparatus of claim 1, wherein an air inlet pipe provided with a flow control valve is connected to the other side of the gas flow path, to control a partial pressure of the emission-regulated gas formed in the gas flow path.

6. The exhaust gas treatment apparatus of claim 1, wherein the gas/liquid separation membrane is a hollow fiber membrane in which the gas flow path or the liquid flow path is formed.

7. The exhaust gas treatment apparatus of claim 1, wherein the gas/liquid reactor comprises a housing connected to an exhaust gas discharge device, and a treatment liquid spraying unit spraying the treatment liquid into the exhaust gas flowing through the housing.

8. The exhaust gas treatment apparatus of claim 7, wherein the treatment liquid spraying unit comprises a treatment liquid flow pipe connected to the treatment liquid supply tank, passing through one surface of the housing, and provided in the housing, and a treatment liquid spraying nozzle provided in a portion of the treatment liquid flow pipe provided in the housing.

9. The exhaust gas treatment apparatus of claim 1, wherein a heat exchanger is connected to the treatment liquid supply tank, to cool the treatment liquid stored in the treatment liquid supply tank.

10. The exhaust gas treatment apparatus of claim 1, wherein the emission-regulated gas is sulfur oxide or carbon dioxide, and the treatment liquid is seawater or an alkaline aqueous solution.

11. An exhaust gas treatment apparatus comprising:

a gas/liquid reactor contacting exhaust gas and a treatment liquid, to absorb and remove an emission-regulated gas included in the exhaust gas, in the treatment liquid;

a gas/liquid separation treatment liquid regeneration unit separating the emission-regulated gas from a waste treatment liquid in which the emission-regulated gas is absorbed, drained from the gas/liquid reactor, to regenerate the waste treatment liquid as a treatment liquid; and a gas treatment unit treating the emission-regulated gas separated from the gas/liquid separation treatment liquid regeneration unit, wherein the gas treatment unit dissolves and treats the emission-regulated gas in seawater in an eco-friendly ion state.

12. The exhaust gas treatment apparatus of claim 11, wherein the gas treatment unit comprises a seawater flow pipe through which the seawater flows and to which a gas recovery pipe connected to the gas/liquid separation treatment liquid regeneration unit is connected.

13. The exhaust gas treatment apparatus of claim 12, wherein a portion of the seawater flow pipe to which the gas recovery pipe is connected is branched as a plurality of branched portions, and the gas recovery pipe is branched and connected to the plurality of branched portions of the seawater flow pipe, respectively.

14. The exhaust gas treatment apparatus of claim 12, wherein a pressure control valve is provided in the seawater flow pipe to increase a pressure of seawater flowing through the seawater flow pipe.

15. The exhaust gas treatment apparatus of claim 12, wherein the gas treatment unit further comprises a microbubble generator provided in the seawater flow pipe to be connected to the gas recovery pipe.

16. The exhaust gas treatment apparatus of claim 15, wherein a plurality of micropores are formed in the microbubble generator.

17. The exhaust gas treatment apparatus of claim 15, wherein the gas treatment unit further comprises a gas mixer provided in a portion of the seawater flow pipe, next to the microbubble generator, in a flow direction of the seawater, to mix the seawater and the emission-regulated gas.

18. The exhaust gas treatment apparatus of claim 11, wherein, in the gas/liquid separation treatment liquid regeneration unit, a gas/liquid separation membrane through which the emission-regulated gas can pass but the waste treatment liquid cannot pass partitions a liquid flow path through which the waste treatment liquid flows and a gas flow path through which the emission-regulated gas flows, and a low partial pressure of the emission-regulated gas is formed in the gas flow path such that the emission-regulated gas included in the waste treatment liquid of the liquid flow path passes through the gas/liquid separation membrane to move to the gas flow path.

19. The exhaust gas treatment apparatus of claim 11, further comprising a treatment liquid supply tank supplying the treatment liquid to the gas/liquid reactor and storing the treatment liquid regenerated in the gas/liquid separation treatment liquid regeneration unit.

* * * * *